United States Patent [19]

Lövgren

[11] 4,446,800

[45] May 8, 1984

[54] APPARATUS FOR FIRING SOLID FUELS

[75] Inventor: Anders Lövgren, Myckle, Sweden

[73] Assignee: HB Megaron, Sweden

[21] Appl. No.: 356,358

[22] Filed: Mar. 9, 1982

[51] Int. Cl.[3] ..... F23N 11/10

[52] U.S. Cl. ..... 110/270; 110/257; 110/258; 110/259; 110/336; 414/157

[58] Field of Search ..... 110/101 CD, 270, 269, 110/336, 255, 257, 258, 259, 329; 414/157

[56] References Cited

U.S. PATENT DOCUMENTS

| | | | |
|---|---|---|---|
| 1,614,237 | 1/1927 | Grunert et al. | 110/270 |
| 3,063,696 | 11/1962 | Culling | 110/269 X |
| 4,193,355 | 3/1980 | Dondeyne et al. | 110/336 |
| 4,308,034 | 12/1981 | Hoang | 110/270 X |

*Primary Examiner*—Edward G. Favors

*Attorney, Agent, or Firm*—Burns, Doane, Swecker & Mathis

[57] ABSTRACT

This invention relates to a boiler installation for the combustion of solid fuels, for example forest waste material in the form of e.g. bark and/or chips, peat pellets, coal etc., which installation comprises a furnace located in connection to a heat medium portion and a grate located in the furnace. The grate feeds fuel from a fuel charge opening through the furnace while the fuel is being combusted, from which furnace the flue gases flow to the heat medium portion and continue to a chimney. The installation also includes at least one intake for controlled supply of combustion air in the form of at least primary and secondary combustion air. In order to improve the efficiency degree of such boiler installations and to render possible efficient and complete combustion of forest waste material and other biologic fuels, which may have a high moisture content, the rear portion of the grate means of the boiler installation, seen in the direction of movement, is located outside of the furnace space proper but connected thereto for forming a zone in connection to the charge opening for a certain drying of the fuel before it is fed into the furnace by the grate. The grate comprises transverse dogs running on a grate plane for advancing the fuel through the furnace, which grate plane is located above an arrangement for the supply of the primary combustion air from below to the fuel, and below the air intakes for the secondary combustion air.

9 Claims, 7 Drawing Figures

APPARATUS FOR FIRING SOLID FUELS

BACKGROUND AND SUMMARY OF THE PRESENT INVENTION

This invention relates to a boiler installation for the combustion of solid fuels, for example forest waste material in the form of e.g. bark and/or chips, peat pellets, coal etc., comprising a fire box located in connection to a heat medium portion and in said fire box a grate means. The grate means advances fuel through a fuel charge opening through the fire box while the fuel is being combusted, from which fire box the flue gases flow to the heat medium portion and continue to a chimney. The boiler includes at least one intake for adjustable supply of combustion air in the form of at least primary and secondary combustion air.

The utilization of forest waste material and other biologic material as fuel has increased, in spite of the absence of efficient boiler installations, which with high efficiency degree, due to great variations of the continuous load are capable to combust such forest waste material. The material possesses such disadvantages as for example highly varying quality and varying moisture content and a moisture content often amounting to 70% and even higher.

An object of the present invention, therefore, is to bring about such a boiler installation, which renders it possible to combust with high efficiency degree and completely forest waste material and other biologic fuels, which may have a high moisture content, without requiring these fuels first to be dried. The installation, besides, shall be manufactured and mounted in a simple way. These objects and others are achieved by the boiler installation according to the present invention.

BRIEF DESCRIPTION OF THE DRAWINGS

The invention is described in greater detail in the following, with reference to the accompanying drawings, in which.

DETAILED DESCRIPTION OF THE PREFERRED EMBODIMENTS

Figure 1:
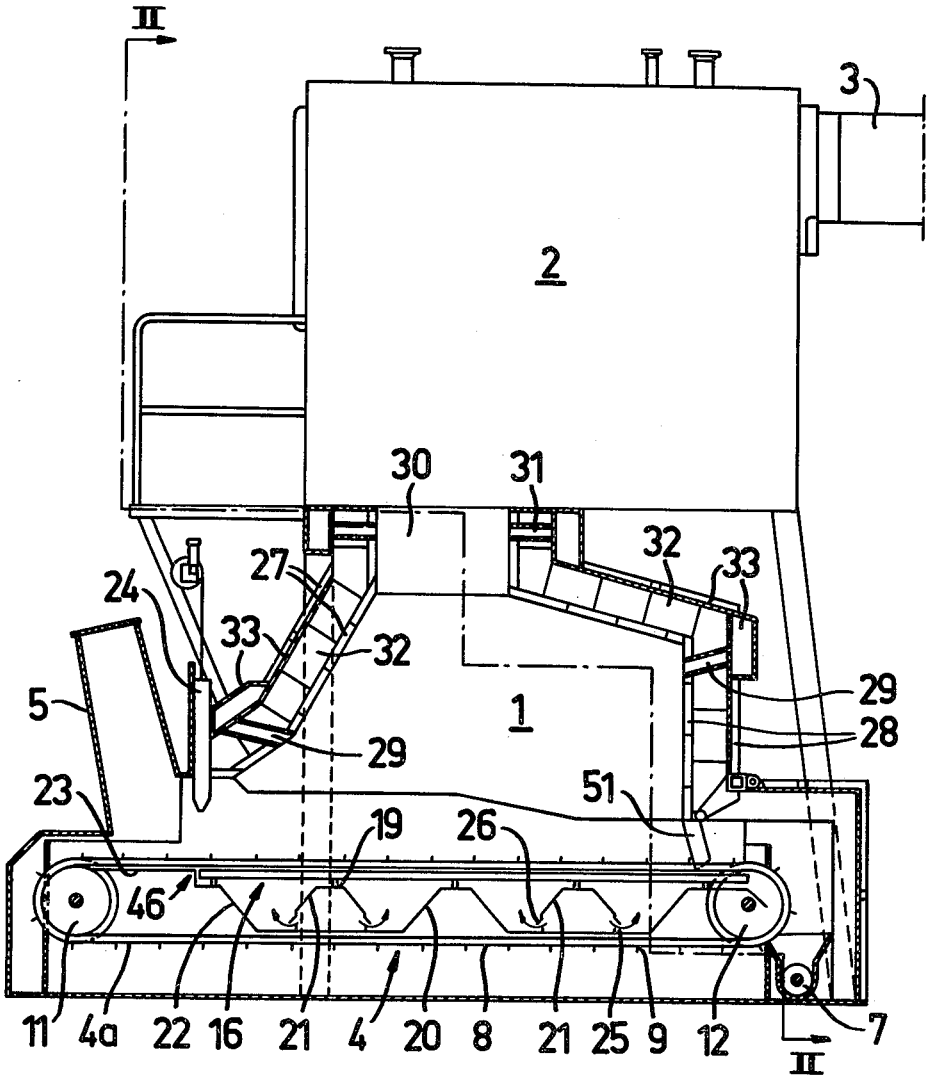
FIG. 1 is a lateral view, partially in section, of a boiler installation according to the invention.

The present boiler installation for solid fuels comprises a fire box or furnace generally designated by 1, and in connection to the furnace 1 a heat medium portion 2, through which the flue gases are led to a chimney via a smoke pipe 3. A medium flowing through the heat medium portion 2 is evaporated or heated by means of the heat, which is generated by combustion of fuel in the furnace, where steam, water or air can be used as heat medium. The heat medium portion 2 may be of any known design and does not constitute an essential part of the present invention and, therefore, is not shown in detail in the drawings nor described.

In the furnace 1 a substantially horizontal grate means 4 is located which effects fuel migration through the furnace space. The grate means extends over the entire furnace space from a fuel charge dip or shaft 5 to an ash discharge screw 7 driven by a motor 6 for discharging the ash automatically. The grate means 4, which hereinafter will be called a scraper grate, comprises a movable feeding portion **4*a*, which is provided with scrapers or dogs 9, and a stationary scraper bottom 4*b*, on which the fuel is fed by the feeding portion 4*a* through the furnace 1** and combusted during the feed.

Figure 2:
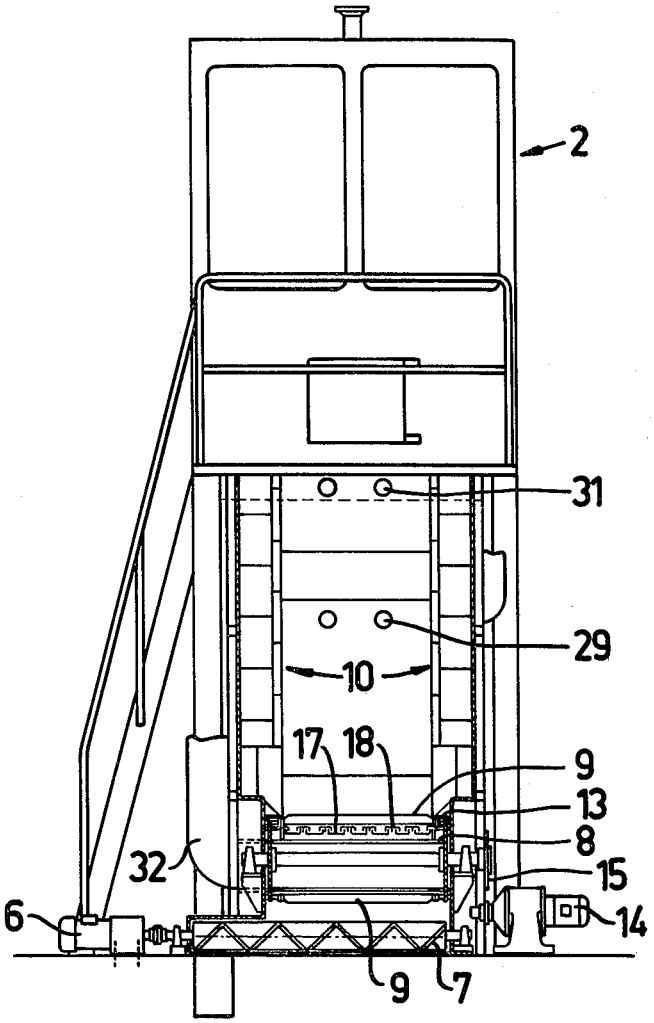
FIG. 2 is a view of the boiler installation, partially in section, substantially along the line II—II in FIG. 1.

The feeding portion **4*a* of the scraper grate comprises two endless chains 8, which between themselves support the dogs 9 of the feeding portion, which dogs extend with full height between opposed sidewalls 10 of the furnace, as shown in FIG. 2. The chains 8 with their dogs 9 run over two end rollers 11 and 12, which are located outside the furnace space proper, and with their upper strand running in guide grooves 13 in the sidewalls 10 of the furnace. One of the end rollers 11,12 is driven, for example the end roller 12 located at the discharge end of the scraper grate, as shown in FIGS. 1 and 2. The roller is driven by a motor 14 via a transmission 15 with a speed, which is adjusted automatically in response to the prevailing conditions. The end roller 12 is shown to be open and is mounted with its axle 14 in bearings 15. In a way similar to the end roller 12, also the end roller 11** can be designed and mounted.

Along the upper strand of the scraper grate the dogs 9 of the feeding portion are arranged to run upright edgeways on the scraper bottom **4*b*, which in the fire box space proper consists of a grate 16. In the embodiment shown in FIGS. 1 and 2, the grate 16 consists of longitudinal U-sections 17, which are arranged with their legs facing upward, and of longitudinal U- or E-sections 18 located on the upward facing U-sections and facing with their legs upward. The grate 16 rests with base irons 19 on transverse ridges 20,21 of a plate 22 located between the upper and lower strands of the scraper grate chains. A portion 23 of the plate 22 forms that portion of the scraper bottom which is located below the fuel charge dip 5 and constitutes the fuel feed portion of the scraper grate. The amount of fuel, which the scraper grate by means of its dogs 9 is permitted to take along from the feed portion is controlled by means of a liftable and lowerable door 24. The door 24 is located in the direction of movement of the scraper grate after the charge dip 5 above the scraper grate 4, and the position of the door 24 above the same thus detrmines the thickness of the fuel bed fed, which the scraper grate 4** takes along into the fire box or furnace space.

Of the transverse ridges 20 and 21, which are formed in the plate 22 located between the upper and lower strand of the scraper grate chains 18, the ridges 21 are provided with air passageways for supplying primary combustion air from below to the fuel bed, which migrates slowly on the air permeable grate 16. The air passageways 21 preferably are provided at their sides with outflow apertures 25, which are provided with valves or flaps 26. The flaps 26 not only render it possible that the outflowing air can be directed so that the air sweeps over the sides of adjacent ridges for cooling the same, but also permits control of the air flow, such that the combustion is maintained at the intended level in the fuel bed along the entire length thereof. The primary air substantially is used for gasification (pyrolysis) and a certain combustion in the fuel bed to $CO_2$.

In the end walls 27 and 28 of the furnace space air intakes 29 are located for supplying secondary combustion air on different levels above the fuel bed, and the secondary air substantially is used for effecting combustion to $CO_2$, which delivers heat, in addition to the heat medium portion 2, also to the feed portion for successively drying fuel charged through the dip 5 while the fuel is being introduced into the combustion zone proper.

In the transition 30 of the furnace space to the heat medium portion 2, which transition in relation to the space in general in narrow and thereby acts as a speed-increasing throttling, additional air intakes 31 are located for supplying tertiary combustion air to the transition zone 30. In the transition 30, flue gases coming from below are combusted completely without affecting the temperature at the beginning of the fuel bed.

For the supply of air to the air intakes 29 and 31 for the secondary and tertiary air and to the intakes of the primary air, the intakes are connected to air passageways 32, 33 located within and on the outside of the walls of the furnace space, whereby the combustion air is preheated prior to its participation in the combustion. Incoming air first flows upward through the internal passageways 32 and then to the different intakes through the outside passageways 33.

The walls 10,27 and 28 of the furnace space consist of sintered aluminium blocks, which are assembled so as to form the internal air passageeays 32. The walls withstand high temperatures and have low thermal conductivity, whereby the temperature in the furnace can be maintained on a level as high as up to 2500° C., but at the same time the furnace walls consisting of sintered aluminium withstand great temperature variations.

These high temperatures also imply high requirements on the scraper grate 4 and especially on its dogs 9 and the sections 17 and 18 forming the grate 16. For this reason, the sections and at least the dogs 9 are made of silicon carbide, which also withstands temperatures as high as up to 2000°–2500° C.

In FIGS. 3–8 the grate 16 of the scraper grate is shown by way of a modified embodiment, which comprises a plurality of substantially identical sections 34 arranged one after the other, which are supported by a frame 35. The frame 35 is located on the ridges 20,21 and preferably consists of box beams 36, through which air can be passed for cooling purposes and thereafter be used as combustion air. Each such section 34 comprises a number of grate plates 37 located to the side of each other. An end 38 of the plates 37, which end 38 in the feed direction of the fuel is the forward end and which in relation to the plate in general is offset by a distance corresponding to the plate thickness, rests against a corresponding support iron 39 extending between the longitudinal beams of the frame, and which with their rear end are supported by the forward offset end 38 of the plates located behind. The plates 37 comprised in the first section 34 are supported at their rear end in said direction of movement by a support iron 40 located on the transverse beam of the frame, and additional support irons are provided between the ends of each section, as shown at 41 in FIG. 3.

Figure 6:
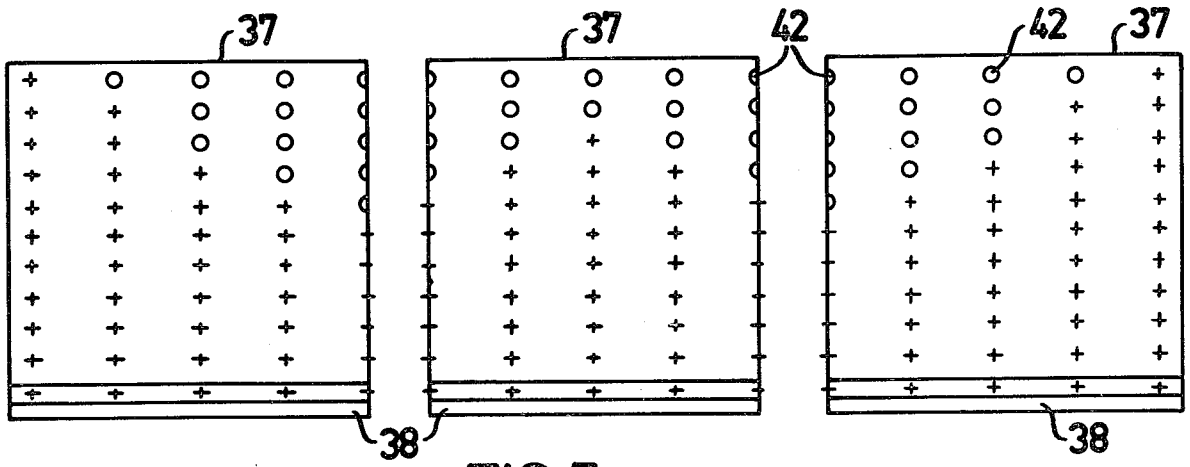
Figure 7:
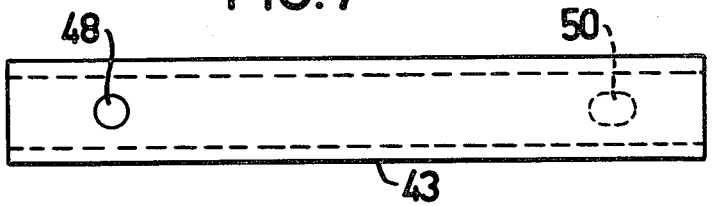

The grate plates 37 are provided over their entire surface with holes 42, which are arranged in longitudinal rows with equal spaced relationship between the hole rows. In the embodiment shown in FIGS. 3–8 one hole row is located in each joint between two plates 37 facing toward each other, and the holes 42 are formed in the edge portions of these plates facing toward each other, as shown in FIG. 6. Above each such hole row a U-shaped grate bar 43 is located which consists of silicon carbide or corresponding material, which bar with its legs facing downward is supported by at least two distance members 44,45. The distance members 44,45 by means of pins 46 are located with play in one of the first and, respectively, last holes 42 in each hole row, as appears from FIG. 4. The distance member 44 of each bar which is the rear distance member in the direction of movement of the fuel has a pin 47, which extends with play into a through hole 48 in the bar, while the distance member 45 of each bar which in said direction of movement is the forward distance member has a pin 49, which with play extends into a longitudinal slot 50 or groove in the lower surface of the bar, in order to permit a certain movement between the bar and the distance member. In FIG. 4 is shown that the distance members 44 can be fixed both on the plate 37 and the bar 43, and the distance members 45 only on the plate by means of refractory cement 51, but the distance members 44,45 also can be arranged loosely in relation to both the plates and the bars.

The primary air flowing in through the air passageways 21, thus, flows upward through the free holes 42 of the plates located beneath the grate bars 43 and thereby is caused to first sweep the inside of each bar and then the upper side of the plates 37, before it arrives at the fuel bed above the grate bars 43. Hereby an efficient continuous cooling of the grate 16 and simultaneously an efficient preheating of the primary combustion air is obtained. Due to the cooling of the grate, no other parts in the same except the grate bars 43 must be manufactured of material withstanding high temperatures, such as silicon carbide and corresponding material, and in spite thereof the grate is highly resistent even to temperatures as high as up to 2500° C. in the combustion space.

In the embodiment according to FIGS. 3–8 and FIGS. 1 and 2 the dogs 9 of the scraper grate can be provided with projections (not shown), which extend downward between the grate bars 43 for scraping along the fuel and/or ash, which may be found between the grate bars 43. The space beneath the bars 43 in principle is maintained clean of fuel and ash by inflowing primary air.

Figure 3:
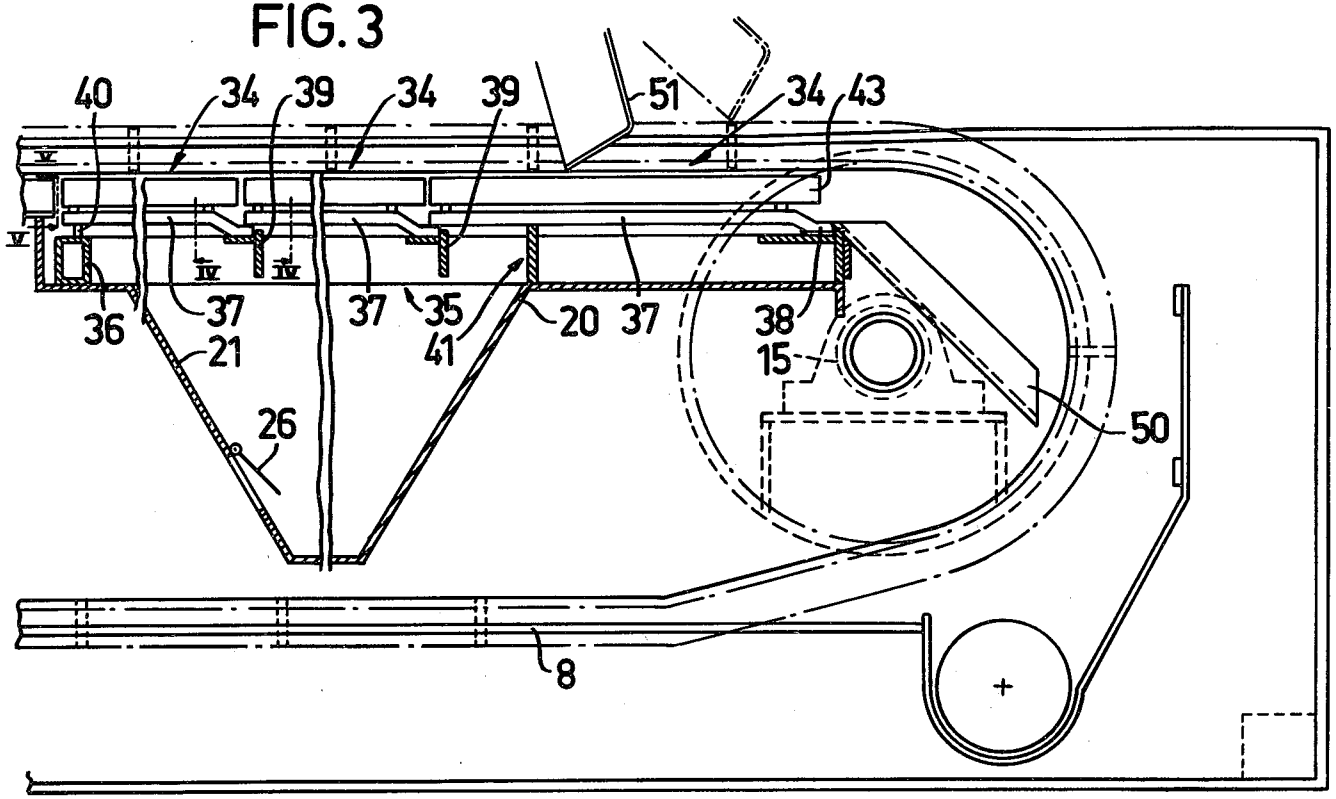
FIG. 3 shows schematically a modified embodiment of the stationary grate bed of a present boiler installation, in a lateral view.
Figure 4:
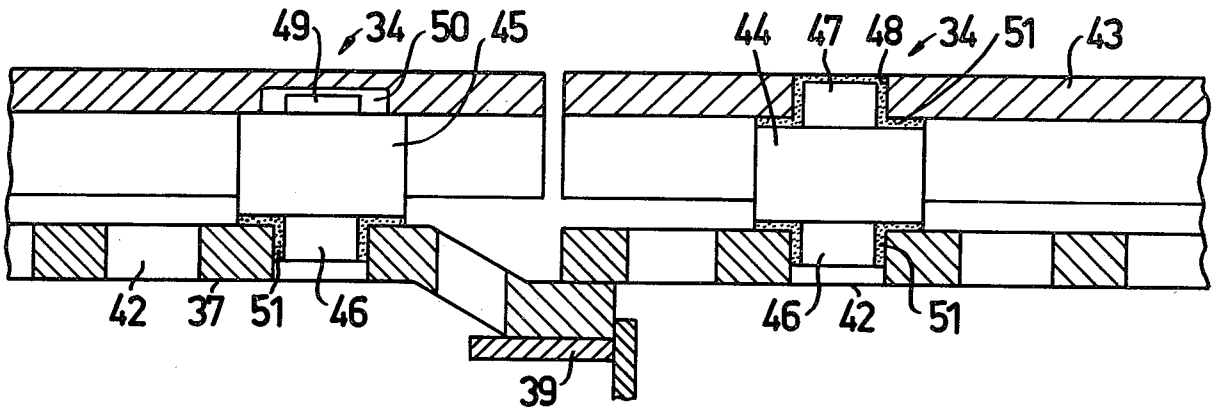
FIG. 4 is a longitudinal section on an enlarged scale between substantially the lines IV—IV in FIG. 3.
Figure 5:
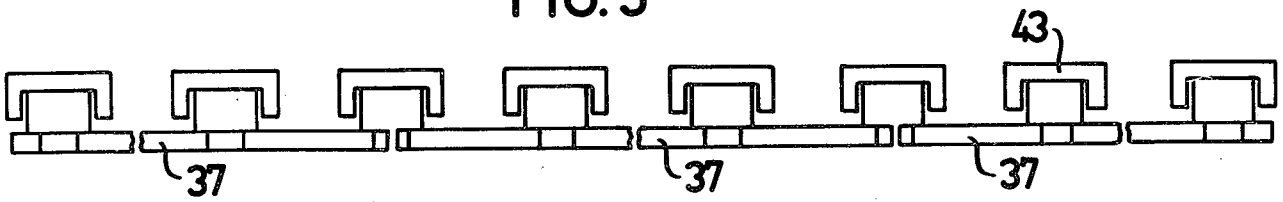
FIG. 5 is on an enlarged scale a section substantially along the line V—V in FIG. 3, and FIGS. 6 and 7 are horizontal views of plates and, respectively, a bar comprised in the stationary grate bed shown in FIG. 3.

At the end of the grate in FIG. 3 a slide groove 50 is shown for transferring ash from the grate to the ash discharge screw 7.

Though not shown in detail, the boiler can be provided with an automatic ignition device and with means for recovering heat from outgoing flue gases which heat then can be utilized for heating the combustion air and pre-drying the fuel, especially when the fuel consists of bark and peat.

According to the principles on which the present invention is based, the fuel, which continuously and automatically is fed in through the charge dip 5 so that the fuel feed portion always is filled with fuel, is fed from this portion, in which the fuel is caused to commence to dry, in a controlled amount into the furnace, and is gasified and combusted successively, in such a manner, that the combustion temperature increases while the fuel migrates through the furnace. During its migration the fuel is subjected by the dogs of the scraper grate also to a certain stirring, which improves the air supply to the fuel and, thus, contributes to a very efficient and complete combustion being obtained. At the end, there remains only ash which is fed down automatically into the opening with funnel-shaped cross-section of the ash discharge conveyor. At the lower portion of the end wall 28 of the furnace a flap 51 of the same material as the walls 10,27,28 is pivotally suspended, by means of which the fuel can be stopped when for some reason it is not combusted completely.

The present invention is not restricted to what is described above and shown in the drawings, but can be altered and modified in many different ways within the scope of the invention idea defined in the attached claims.

What I claim is:

1. An apparatus for combusting solid fuels such as forest waste material in the form of bark and/or chips, and other biological materials including peat, comprising a furnace, a heat medium portion being connected to the furnace, grate means located in the furnace for feeding fuel from a fuel charge opening through the furnace while the fuel is being combusted in a furnace space, flue gases flowing from said furnace space through the heat medium portion to a chimney, at least one intake for supplying a controlled supply of at least primary and secondary combustion air to the furnace space, the grate means having a rear portion, seen in the direction of movement, located outside the furnace space proper but in connection therewith, said rear portion forming a drying zone adjacent the charge opening for effecting a partial drying of the fuel before the fuel is fed by the grate means into the furnace space, the grate means further including a plurality of transverse dogs running in contact with an upper surface of a stationary grate plane for advancing the fuel through the furnace, the grate plane being located above means for supplying the primary combustion air from below to the fuel, and below air intakes for supplying the secondary combustion air.

2. The apparatus as defined in claim 1, wherein the walls of the furnace consist of blocks of sintered aluminum.

3. The apparatus as defined in claim 1 or 2, wherein a portion of the grate plane which is located within the furnace space proper, comprises longitudinal sections of silicon carbide, the dogs of the grate means being comprised of silicon carbide.

4. The apparatus as defined in claim 1, further comprising a relatively narrow transition zone from the furnace space to the heat medium portion, tertiary combustion air being supplied in said transition zone.

5. The apparatus as defined in claim 1, further comprising a liftable and lowerable member located adjacent the drying zone and above the grate means for controlling the amount of fuel taken along by the grate means into the furnace space.

6. The apparatus as defined in claim 1, wherein the dogs of the grate means are connected at their ends to endless chains, the chains running over end rollers with an upper strand of the chains running in guide grooves on opposed sidewalls of the furnace.

7. The apparatus as defined in claim 1, further comprising a screw conveyor at the discharge end of the grate means for automatic ash discharge.

8. The apparatus as defined in claim 1, wherein the grate plane includes longitudinal U-shaped sections supported by spaced members arranged on plates, the plates having longitudinal rows of holes therein for supplying the primary combustion air.

9. The apparatus as defined in claim 8, wherein a U-shaped section is located above each longitudinal row of holes, the legs of the U-shaped sections facing downward toward the plates.

* * * * *

UNITED STATES PATENT AND TRADEMARK OFFICE

CERTIFICATE OF CORRECTION

PATENT NO. : 4,446,800

DATED : May 8, 1984

INVENTOR(S) : Anders Lövgren

It is certified that error appears in the above-identified patent and that said Letters Patent is hereby corrected as shown below:

On the Title page, after the line stating "[22] Filed: March 9, 1982", insert --

Foreign Application Priority Data

March 10, 1981 [SE] Sweden.... 8101498 --.

Signed and Sealed this

Seventeenth Day of August, 1993

Bruce Lehman

*Attest:*

BRUCE LEHMAN

*Attesting Officer*

*Commissioner of Patents and Trademarks*